United States Patent [19]

Massari

[11] 4,328,721

[45] May 11, 1982

[54] PHILLIPS SCREWDRIVER WITH RETRACTABLE SLOTTED SCREW DRIVER BLADE

[76] Inventor: Frank Massari, 4301 Bayshore Blvd., Tampa, Fla. 33611

[21] Appl. No.: 185,673

[22] Filed: Sep. 10, 1980

[51] Int. Cl.[3] ..... B25G 1/00

[52] U.S. Cl. ..... 81/439; 81/437; 145/64

[58] Field of Search ..... 81/439, 437, 442, 444, 81/461; 145/64

[56] References Cited

U.S. PATENT DOCUMENTS

| | | | |
|---|---|---|---|
| 138,528 | 5/1873 | Reed et al. | 145/64 |
| 180,187 | 7/1876 | Bartlett | 145/64 |
| 468,595 | 2/1892 | Bunch | 145/64 |
| 1,345,708 | 7/1920 | Schneider | 81/439 |
| 1,501,222 | 7/1924 | Lamp | 81/439 |
| 2,329,398 | 9/1943 | Duffy | 81/442 |
| 2,545,813 | 3/1951 | Jackson | 145/64 |
| 2,682,414 | 6/1954 | Richardson | 145/64 |
| 2,822,714 | 2/1958 | Paparelli | 81/439 |
| 3,127,798 | 4/1964 | Gol | 81/439 |
| 3,255,792 | 6/1966 | Beck | 145/64 |

FOREIGN PATENT DOCUMENTS

| | | | |
|---|---|---|---|
| 317580 | 1/1957 | Switzerland | 145/64 |

*Primary Examiner*—Stephen G. Kunin
*Assistant Examiner*—J. T. Zatarga
*Attorney, Agent, or Firm*—Harvey B. Jacobson

[57] ABSTRACT

A tubular shank is provided having front and rear ends and including handle defining structure at its rear end and a Phillips head screw engaging tip on its front end. The tip is of the type including four equally peripherally spaced, forwardly tapering and generally radially extending Phillips screw head socket arm portion engaging lugs and includes a central passage extending therethrough opening lengthwise rearwardly into the interior of the tubular shank and forwardly through the forward end of the tip. The passage is generally rectangular in cross-sectional shape with its major transverse center line substantially bisecting the included angles formed between remote pairs of adjacent lugs of the tip. An elongated slotted screwdriver blade is guidingly lengthwise reciprocal through the passage and forwardly extendable past the forward end of the tip and retractable rearwardly from at least the forward portion of the tip.

8 Claims, 6 Drawing Figures

PHILLIPS SCREWDRIVER WITH RETRACTABLE SLOTTED SCREW DRIVER BLADE

BACKGROUND OF THE INVENTION

There are many instances in which slotted head screwdrivers and Phillips head screwdrivers must be used alternately and, accordingly, various forms of screwdrivers provided with interchangeable slotted screw head tips and Phillips head tips heretofore have been provided. However, the necessity of having to substitute one tip for another and the possible loss of a tip not in use constitute some of the disadvantages of screwdrivers including replacing tips.

In order to overcome these and other disadvantages of interchangeable tip screwdrivers, a need exists for a screwdriver which may be alternately used in conjunction with slotted head screws as well as Phillips head screws independent of removing one screwdrive tip and replacing it with a second screwdriver tip.

Various forms of screwdrivers and other similar devices including alternately usable tips are disclosed in U.S. Pat. Nos. 1,645,753; 2,544,834; 2,546,489 and 3,633,640. However, these previously known devices still include the disadvantages of screwdrivers and other similar tools including alternately usable replaceable tips.

BRIEF DESCRIPTION OF THE INVENTION

The screwdriver of the instant invention includes a Phillips head tip supported from the forward end of a tubular shank and the tip is provided with a passage extending lengthwise therethrough and opening rearwardly into the interior of the tubular shank. The passage through the tip is generally rectangular in cross-sectional shape with its major dimension center line substantially bisecting the included angles defined between remote pairs of adjacent lug portions of the Phillips tip. A screwdriver blade is lengthwise guidingly reciprocal through the passage and includes a slotted screw head engaging forward end projectable forwardly of the screwdriver tip and retractable rearwardly of at least the forward portions of the lugs of the tip. In this manner, the screwdriver may be utilized in conjunction with a Phillips head screw when the rectangular blade is in the retracted position and in conjunction with slotted screw heads when the blade is in the extended position.

The blade is spring biased toward its retracted position and may be releasably latched in the extended position. The tubular shank of the screwdriver opens through the rear end of the screwdriver and the rear end of the retractable blade of the screwdriver is disposed generally flush with the rear end of the shank when the blade is in the retracted position.

The main object of this invention is to provide a screwdriver which may be used, alternately, in conjunction with slotted head screws and Phillips head screws.

Another object of this invention is to provide a screwdriver in accordance with the preceding objects and which does not utilize interchangeable tips which may be accidentally misplaced.

A further object of this invention is to provide a screwdriver including a Phillips head tip and a straight screwdriver blade extendable and retractable relative to the tip in a manner such that the retracting and extending processes may each be accomplished during a period of less than one second duration.

A final object of this invention to be specifically enumerated herein is to provide a screwdriver in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figures 1, 2, 3, 4, 5, 6:
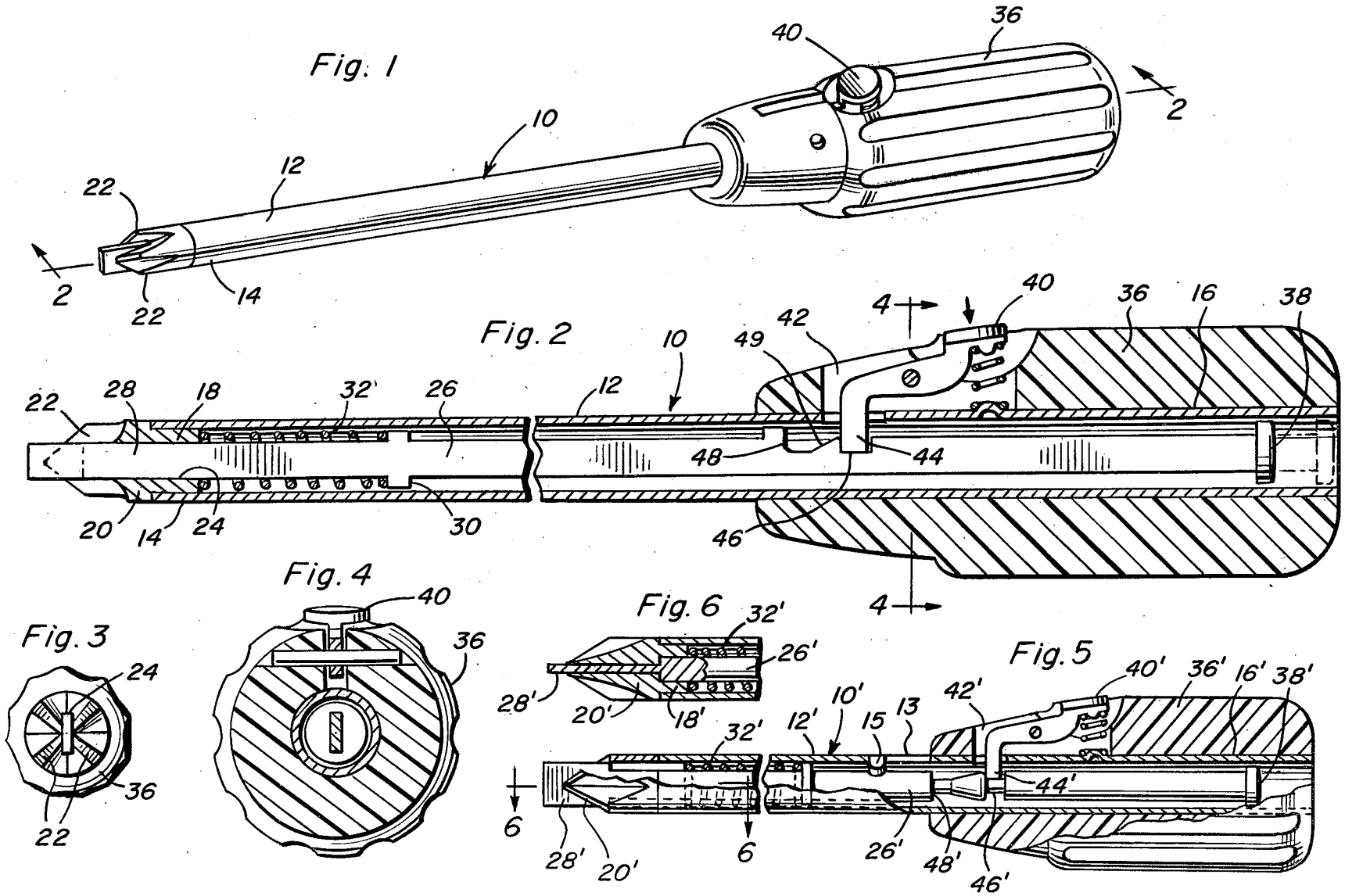
FIG. 1 is a perspective view of the screwdriver of the instant invention with the straight blade thereof in an extended position.
FIG. 2 is an enlarged longitudinal vertical sectional view taken substantially upon the plane indicated by the section line 2—2 of FIG. 1.
FIG. 3 is an enlarged fragmentary end elevational view of the screwdriver as seen from the left side of FIG. 1.
FIG. 4 is a transverse vertical sectional view taken substantially upon the plane indicated by the section line 4—4 of FIG. 2.
FIG. 5 is a side elevational view of a second form of the screwdriver constructed in accordance with the present invention with portions thereof being broken away and illustrated in vertical section.
FIG. 6 is a fragmentary vertical sectional view taken substantially upon the plane indicated by the section line 6—6 of FIG. 5.

Referring now more specifically to the drawings, the numeral 10 generally designates the screwdriver of the instant invention. The screwdriver 10 includes an elongated generally cylindrical shank 12 including front and rear end portions 14 and 16. The front end portion 16 of the shank 12 has a diametrically reduced mounting shank portion 18 of a Phillips head screw engaging tip 20 secured therein. The forward end of the tip 20 includes four peripherally spaced forwardly tapering and generally radially extending Phillips screw head socket arm portion engaging lugs 22, as is conventional.

The tip 20 includes a longitudinally extending passage 24 formed centrally therethrough and the passage 24 opens rearwardly into the tubular shank 12. The front end of the passage 24 opens forwardly between the outer peripheral portions of the lugs 22 and it will be noted that the passage 24 is substantially rectangular in cross-sectional shape with the major dimension center line thereof substantially bisecting the included angles defined between remote pairs of adjacent lugs 24.

An elongated blade 26 includes a forward end portion 28 which is generally rectangular in cross-sectional shape and is guidingly reciprocal through the passage 24. The forward end portion 28 is extendable forwardly of the lugs 22 in the manner illustrated in FIGS. 1 and 2 of the drawings and is retractable rearwardly of at least the forward portions of the lugs 22. The blade 26 includes an enlargement 30 thereon spaced rearward of the tip 20 and a compression spring 32 is disposed about the forward end portion 28 between the enlargement 30 and the diametrically reduced shank portion 18 of the tip 20. The spring 32 yieldingly biases the blade 26 toward its rearwardly displaced retracted position.

The rear end portion 16 of the shank 12 includes a diametrically enlarged handle 36 supported therefrom and opens rearwardly through the rear end of the handle 36. The rear end of the blade 26 includes an enlarged guide and abutment head 38 thereon guidingly received in the rear end portion 16 of the shank 12 and which may be engaged by a finger of the user of the screwdriver 10 from the rear end of the handle 10 in order to forwardly displace the blade 26 against the biasing action of the spring 32 until the blade 26 is in its forwardly extended position.

In addition, a spring biased pivoted lever 40 is mounted within a recess 42 provided therefor in the handle 36 and includes a tang portion 44 releasably engageable in a laterally opening recess 46 formed in the blade 26 in order to releasably retain the blade 26 in its forwardly projecting extended position. Further, the blade 26 also includes an abutment surface 48 engageable with the tang 44 in order to limit rearward displacement of the blade 26 under the biasing action of the spring 32. The blade 26 also includes a cam surface 49 engageable with the tang 44 in order to enable the latter to pivot to an out of the way position during forward displacement of the blade 26 from the rearwardly displaced retracted position to the forwardly displaced extended position thereof.

With attention now invited more specifically to FIGS. 5 and 6 of the drawings, there may be seen a modified form of screwdriver referred to in general by the reference numeral 10'. The screwdriver 10' includes many components corresponding to the above noted components of the screwdriver 10 and which have therefore been designated by corresponding prime reference numerals. The main difference between the screwdrive 10' and the screwdriver 10 resides in the fact that only the forward end portion 28' of the blade 26' is rectangular in cross-sectional shape. All but the forward end portion 28' of the blade 26' is circular in cross-sectional shape. However, the shank 12' includes a longitudinal slot 13 in which the outer end of a radial lug 15 is slidingly received, the lug 15 being carried by the blade 26'. Further, equivalents of the recess 46 and the abutment surface 48 are provided at 46' and 48'.

In operation, when it is desired to utilize either the screwdriver 10 or the screwdriver 10' in conjunction with a Phillips head screw, the levers 40 and 40' may be depressed in order to retract the tangs 44 and 44' thereof whereby the springs 32 and 32' will retract the blades 26 and 26'. On the other hand, if it is subsequently desired to utilize the screwdrivers 10 and 10' in conjunction with a slotted head screw, the rear end portions of the blades 6 and 26' may be manually urged forward by finger pressure applied by fingers inserted into the rear end portions 16 and 16' of the tubular shanks 12 and 12' until the tangs 44 and 44' are engaged in the recesses 46 and 46'. Alternately, the screwdrivers 10 and 10' may be manually held and flicked in a manner to extend the blades 26 and 26' by inertia.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A screwdriver for alternate use with Phillips head screws and slotted head screws, said screwdriver including a tubular shank having front and rear ends and including handle defining means at its rear end and a Phillips head screw engaging tip on its front end of the type defining four equally peripherally spaced, forwardly tapering and generally radially extending Phillips screw head socket arm portion engaging lugs, said tip including a centrally located passage extending therethrough opening rearwardly lengthwise into the interior of said tubular shank and through the central portion of said tip at its forward end, said passage being generally rectangular in cross section with its major transverse dimension center line substantially bisecting the included angles formed between remote pairs of adjacent lugs, and a rectangular cross section elongated slotted screwdriver blade guidingly lengthwise reciprocal through said passage and forwardly extendable past the forward end of said tip and retractable rearwardly from at least the forward portion of said tip.

2. The screwdriver of claim 1 including latch means operatively connected between said shank and blade operative to releasably retain said blade in said extended position.

3. The screwdriver of claim 2 including force means operatively connected between said shank and blade yieldingly biasing said blade toward said retracted position.

4. The screwdriver of claim 1 wherein said tubular shank opens outwardly of the rear end of said screwdriver, said blade including an enlarged head guidingly reciprocal in the rear end of said tubular shank and engageably by a finger of the user inserted into the rear end of said tubular shank in order to manually bias said blade forwardly toward the extended position.

5. The screwdriver of claim 4 including force means operatively connected between said shank and blade yieldingly biasing said blade toward said retracted position.

6. The screwdriver of claim 5 including latch means operatively connected between said shank and blade operative to releasably retain said blade in said extended position.

7. The screwdriver of claim 1 wherein the rear end portion of said blade is rectangular in cross-sectional shape.

8. The screwdriver of claim 1 wherein the rear end portion of said blade is circular in cross-sectional shape, an intermediate portion of said tubular shank including an elongated radially opening slot formed therein, said blade including a lug supported therefrom guidingly received in said slot.

* * * * *